US008476891B2

(12) United States Patent
Hikichi et al.

(10) Patent No.: US 8,476,891 B2
(45) Date of Patent: Jul. 2, 2013

(54) CONSTANT CURRENT CIRCUIT START-UP CIRCUITRY FOR PREVENTING POWER INPUT OSCILLATION

(75) Inventors: Tomoki Hikichi, Chiba (JP); Minoru Ariyama, Chiba (JP); Daisuke Muraoka, Chiba (JP); Manabu Fujimura, Chiba (JP)

(73) Assignee: Seiko Instruments Inc., Chiba (JP)

( * ) Notice: Subject to any disclaimer, the term of this patent is extended or adjusted under 35 U.S.C. 154(b) by 428 days.

(21) Appl. No.: 12/956,518

(22) Filed: Nov. 30, 2010

(65) Prior Publication Data

US 2011/0127989 A1 Jun. 2, 2011

(30) Foreign Application Priority Data

Dec. 1, 2009 (JP) ..... 2009-273646

(51) Int. Cl.
*G05F 3/16* (2006.01)

(52) U.S. Cl.
USPC ..... 323/315; 323/901

(58) Field of Classification Search
USPC ..... 323/312, 313, 315, 901
See application file for complete search history.

(56) References Cited

U.S. PATENT DOCUMENTS

| | | | | |
|---|---|---|---|---|
| 5,696,440 | A | 12/1997 | Harada | |
| 7,550,958 | B2 * | 6/2009 | Lee et al. | 323/315 |
| 7,554,313 | B1 * | 6/2009 | Leitner | 323/315 |
| 8,330,516 | B2 * | 12/2012 | Tseng | 327/198 |
| 8,339,117 | B2 * | 12/2012 | Sicard | 323/315 |
| 8,350,611 | B1 * | 1/2013 | Hsu | 327/198 |
| 8,400,124 | B2 * | 3/2013 | Stellberger et al. | 323/275 |
| 2011/0127989 | A1 * | 6/2011 | Hikichi et al. | 323/315 |

FOREIGN PATENT DOCUMENTS

JP 07-106869 A 4/1995

* cited by examiner

*Primary Examiner* — Jeffrey Sterrett
(74) *Attorney, Agent, or Firm* — Brinks Hofer Gilson & Lione

(57) ABSTRACT

Provided is a constant current circuit capable of low current consumption operation, which is prevented from repeating a start-up state and a zero steady state and entering an oscillating state when power is activated. When power is activated, until a node (A) reaches a start-up state, an excitation current is continued to be supplied to a node (B), to thereby reliably start up the constant current circuit in a short period of time without repeating the start-up state and the zero steady state.

10 Claims, 5 Drawing Sheets

CONSTANT CURRENT CIRCUIT START-UP CIRCUITRY FOR PREVENTING POWER INPUT OSCILLATION

RELATED APPLICATIONS

This application claims priority under 35 U.S.C. §119 to Japanese Patent Application No. 2009-273646 filed on Dec. 1, 2009, the entire content of which is hereby incorporated by reference.

BACKGROUND OF THE INVENTION

1. Field of the Invention

The present invention relates to a constant current circuit to be formed on a chip of a semiconductor integrated circuit, and more particularly, to a constant current circuit including start-up means for preventing oscillation when power is input.

2. Description of the Related Art

Constant current circuits are used as current sources for circuits in various types of electronic devices. It is a function of the constant current circuit to output a constant current to an output terminal independently of power supply fluctuations at a power supply terminal. Achieving lower current consumption operation is also an important issue for the constant current circuit.

FIG. 4 illustrates a circuit diagram of a conventional constant current circuit. The conventional constant current circuit includes a constant current circuit section 410 and a determination circuit section 411. The constant current circuit section 410 has an output connected to a gate of a P-channel transistor 407 included in the determination circuit section 411. The determination circuit section 411 has an output connected to a gate of an N-channel transistor 406 included in the constant current circuit section 410.

Next, an operation of the conventional constant current circuit is described.

Immediately after power is input, a potential of an output terminal 422 of the constant current circuit section 410 is still zero, but increases as a power supply voltage 130 increases. When a difference between the voltage of the output terminal 422 and the power supply voltage 130 becomes lower than a threshold voltage of the P-channel transistor 407, the P-channel transistor 407 enters an OFF state. At this time, a potential of a node C is zero and hence a potential of an output terminal of an inverter 408 is High. Accordingly, the N-channel transistor 406 enters an ON state and the potential of the output terminal 422 becomes zero. Then, each gate potential of a P-channel transistor 401 and a P-channel transistor 402 included in the constant current circuit section 410 becomes zero, and hence currents I1 and I2 are excited to nodes A and B, respectively (hereinafter, this operation is referred to as current exciting operation). At the same time as the current excitation, a gate potential of the P-channel transistor 407 decreases so that a current flows through the node C and a load resistor 409. If design is made such that the potential of the node C on this occasion exceeds a logic threshold of the inverter 408, the potential of the output terminal of the inverter 408 may be inverted to zero so that the N-channel transistor 406 enters an OFF state.

In the event that the constant current circuit section 410 cannot be enabled by the excitation currents I1 and I2, a potential of the node B increases to turn OFF the P-channel transistor 407 eventually. Then, the determination circuit section 411 is shifted to the above-mentioned current exciting operation to excite the currents I1 and I2 again to the constant current circuit section 410.

In such a way, the determination circuit section 411 excites the currents I1 and I2 as many times as needed until the constant current circuit section 410 is enabled, to thereby reliably start up the constant current circuit and make a shift to a "constant current state" (see, for example, Japanese Patent Application Laid-open No. Hei 07-106869).

The description above is given to an example where the resistor 409 is used in the determination circuit section 411 as means for converting ON/OFF of the P-channel transistor 407 into a start-up signal. However, the resistor 409 may be replaced with a depletion type N-channel transistor. Specifically, a drain electrode of the depletion type N-channel transistor is connected to the node C of the determination circuit section 411, and gate and source electrodes thereof are connected in common to a ground potential 131. With this connection, the depletion type N-channel transistor may operate as one whose gate-bias voltage is always zero. This provides, as already well known, the effect of reducing an area of a resistor in a circuit requiring high resistance.

However, in the conventional technology, while the start-up state of the constant current circuit section 410 is monitored based on the node B, the excitation current for start-up is supplied to the node B. If the supply of the excitation current is ended before the node A of the constant current circuit section 410 is shifted to the start-up state, the constant current circuit is not allowed to start up and returns into a zero steady state again. This leads to a fear that the constant current circuit repeats the start-up state and the zero steady state to enter an oscillating state. Further, after the start-up of the constant current circuit, a current flows through the determination circuit section 411 all the time, which is not suitable for lower current consumption.

SUMMARY OF THE INVENTION

In order to solve the conventional problems, the present invention provides a constant current circuit having the following configuration.

A constant current circuit includes: a constant current circuit section including: a first transistor including a source connected to a first power source; a second transistor including a drain and a gate which are connected to a drain of the first transistor, and a source connected to a second power source; a third transistor including a source connected to the first power source, and a drain and a gate which are connected to a gate of the first transistor; and a fourth transistor including a source connected to a first resistor, a gate connected to the gate and the drain of the second transistor, and a drain connected to the gate and the drain of the third transistor, the first resistor including one end connected to the source of the fourth transistor and another end connected to the second power source; and a start-up circuit including: a fifth transistor and a sixth transistor each including a gate connected to the gate of the second transistor; and a seventh transistor including a gate connected to drains of the fifth transistor and the sixth transistor, a drain connected to the gate of the third transistor, and a source connected to the second power source.

The constant current circuit according to the present invention provides the following effect. Until a node A reaches a start-up state, an excitation current is continued to be supplied to a node B, to thereby reliably start up the constant current circuit in a short period of time without repeating the start-up state and a zero steady state.

Besides, the following effect is also provided. When a potential of the node A falls below a threshold of the start-up circuit because of disturbance such as power supply fluctuations, the excitation current is supplied again to re-start up the constant current circuit, to thereby prevent the constant current circuit from shifting to the zero steady state.

Further, the start-up circuit has an inverter configuration, and hence a steady current does not continue to flow before and after the start-up, which is still another effect of being suitable for low current consumption operation.

DETAILED DESCRIPTION OF THE PREFERRED EMBODIMENTS

Now, referring to the accompanying drawings, embodiments of the present invention are described below.

First Embodiment

Figure 1:
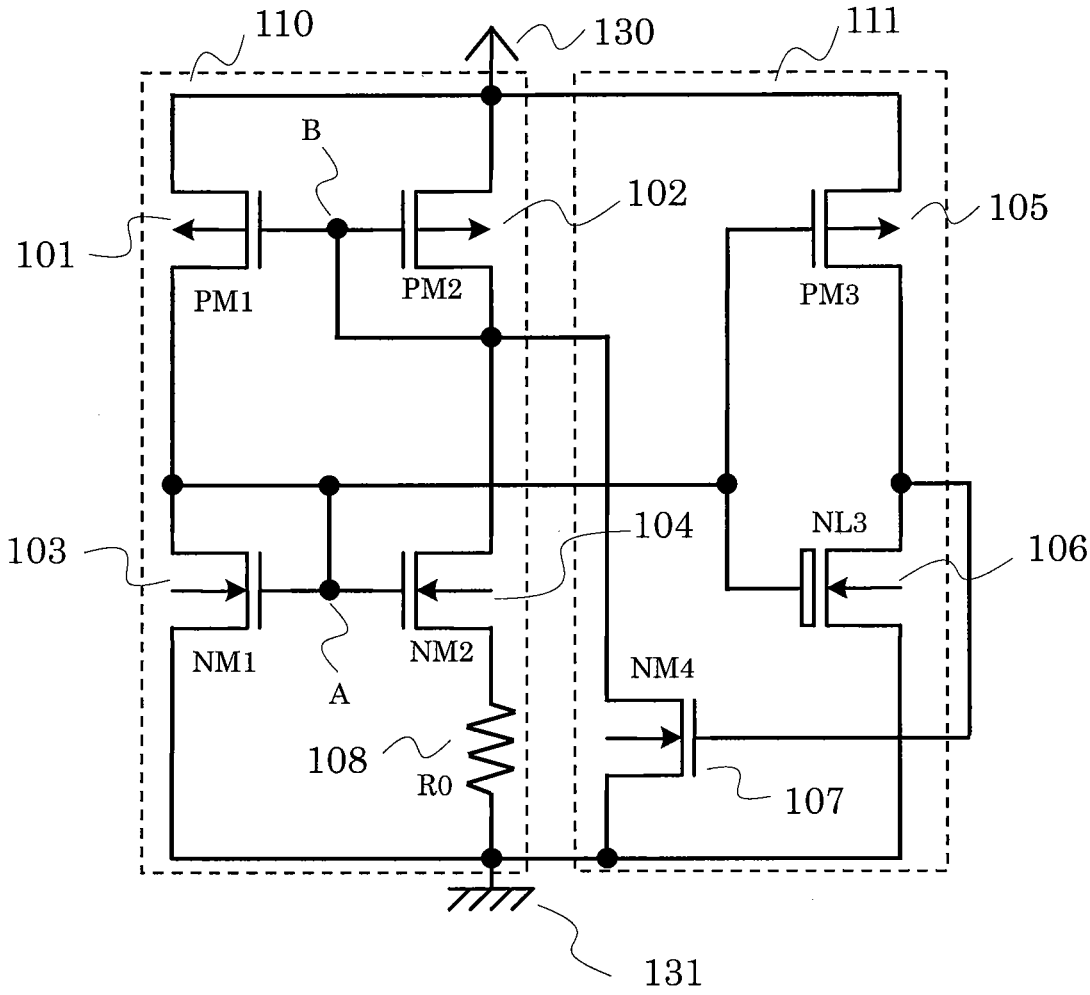
FIG. 1 is a circuit diagram of a constant current circuit according to a first embodiment of the present invention.

FIG. 1 is a circuit diagram of a constant current circuit according to a first embodiment of the present invention.

The constant current circuit according to the first embodiment includes a constant current circuit section 110 and a start-up circuit section 111.

The constant current circuit section 110 includes a P-channel transistor 101, a P-channel transistor 102, an N-channel transistor 103, an N-channel transistor 104, and a resistor 108. The P-channel transistor 101 has a source connected to a power supply terminal 130, a drain connected to a drain of the N-channel transistor 103, and a gate connected to a gate of the P-channel transistor 102. The P-channel transistor 102 has a source connected to the power supply terminal 130, and a drain connected to its own gate and a drain of the N-channel transistor 104. The N-channel transistor 103 has a source connected to a ground terminal 131, and the drain connected to its own gate and a gate of the N-channel transistor 104. The N-channel transistor 104 has a source connected to the resistor 108. The resistor 108 has one end connected to the source of the N-channel transistor 104 and another end connected to the ground terminal 131.

The start-up circuit section 111 includes a P-channel transistor 105, an N-channel transistor 106, and an N-channel transistor 107. The P-channel transistor 105 has a source connected to the power supply terminal 130, a drain connected to a drain of the N-channel transistor 106 and a gate of the N-channel transistor 107, and a gate connected to the gate of the N-channel transistor 103 and a gate of the N-channel transistor 106. The N-channel transistor 106 has a source connected to the ground terminal 131. The N-channel transistor 107 has a source connected to the ground terminal 131 and a drain connected to the gate of the P-channel transistor 102.

Next, an operation of the constant current circuit according to the first embodiment is described.

The N-channel transistor 106 employs a transistor lower in threshold than the N-channel transistor 103 and the N-channel transistor 104.

After power is activated, if a node A has a potential lower than the threshold of the N-channel transistor 106, the P-channel transistor 105 and the N-channel transistor 106 of the start-up circuit section 111 determine that the constant current circuit section 110 is not in a start-up state and thereby output a start-up signal to the N-channel transistor 107. Then, the N-channel transistor 107 draws an excitation current from the P-channel transistor 102. The P-channel transistor 101 and the P-channel transistor 102 together form a current mirror circuit and thereby generate the excitation current to the P-channel transistor 101. The excitation current by the P-channel transistor 101 charges a ground parasitic capacitance of the node A to turn ON the N-channel transistor 103 and the N-channel transistor 104. On this occasion, if each gate potential of the N-channel transistor 103 and the N-channel transistor 104 exceeds a threshold of an inverter formed by the N-channel transistor 106 and the P-channel transistor 105, the output of the inverter is inverted from High to Low. Then, the N-channel transistor 107 is shifted to the cut-off region operation, ending the supply of the excitation current. At this time, sufficient currents flow through the P-channel transistor 101, the P-channel transistor 102, the N-channel transistor 103, and the N-channel transistor 104, and hence the constant current circuit section 110 is shifted to the steady state without fail.

After the constant current circuit section 110 shifts to the steady state, if the potential of the node A falls below the threshold of the inverter of the start-up circuit section 111 because of disturbance such as power supply fluctuations or noise, the excitation current is supplied again to re-start up the constant current circuit, to thereby make a shift to the steady state without fail.

The start-up circuit section 111 has an inverter configuration, and hence a steady current does not continue to flow before and after the start-up, which enables low current consumption operation.

As described above, in the constant current circuit according to the first embodiment, until the node A reaches a start-up state, the excitation current is continued to be supplied to the node B, to thereby reliably start up the constant current circuit in a short period of time without repeating the start-up state and the zero steady state.

Besides, the following effect is also provided. When the potential of the node A falls below a threshold of the start-up circuit section 111 because of disturbance such as power supply fluctuations, the excitation current is supplied again to re-start up the constant current circuit, to thereby prevent the constant current circuit from shifting to the zero steady state.

Further, because the start-up circuit has an inverter configuration, a steady current does not continue to flow before and after the start-up, which is still another effect of being suitable for low current consumption operation.

Second Embodiment

Figure 2:
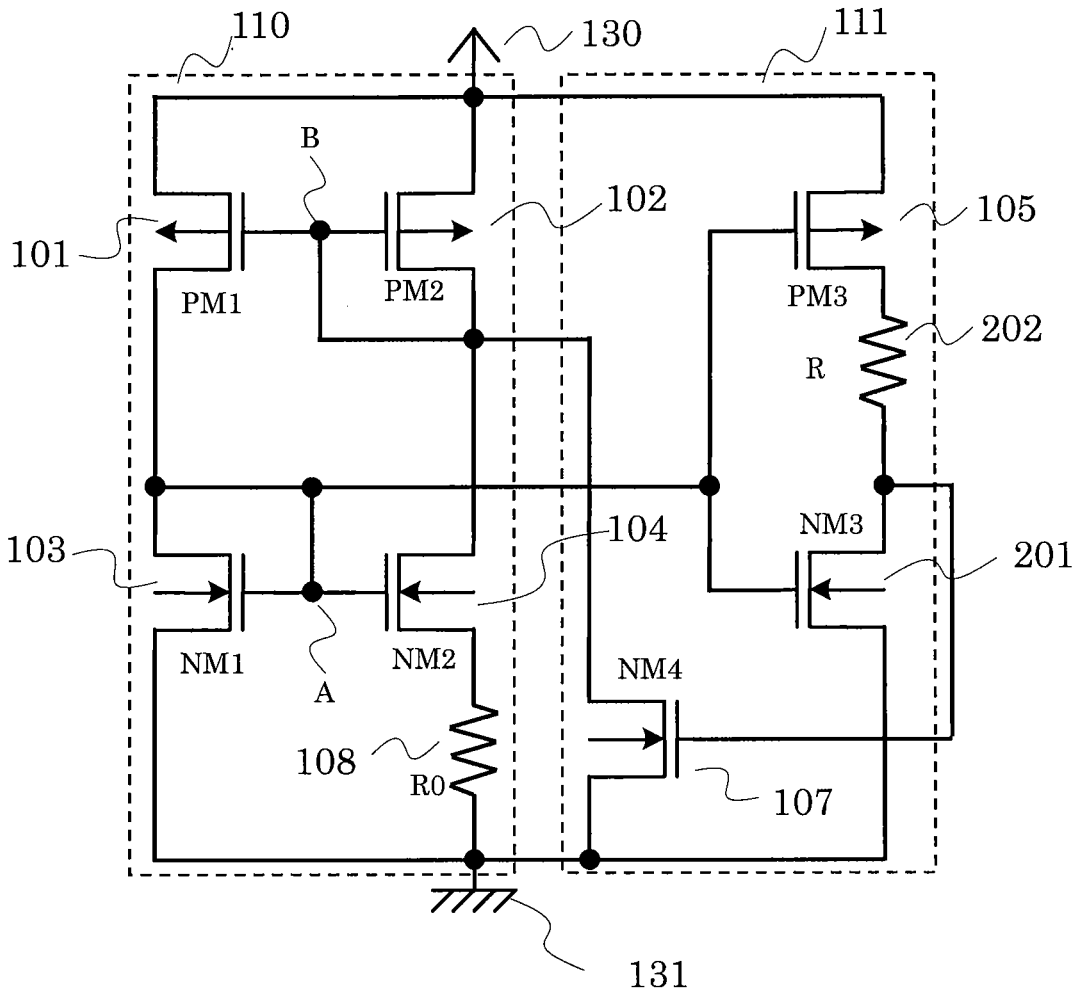
FIG. 2 is a circuit diagram of a constant current circuit according to a second embodiment of the present invention.

FIG. 2 is a circuit diagram of a constant current circuit according to a second embodiment of the present invention.

FIG. 2 is different from FIG. 1 in that a resistor 202 is interposed between an N-channel transistor 201 and the P-channel transistor 105, and that the N-channel transistor 201 has the same threshold as the N-channel transistor 103 and the N-channel transistor 104.

The resistor 202 has one end connected to the drain of the P-channel transistor 105 and another end connected to a drain of the N-channel transistor 201 and the gate of the N-channel transistor 107.

Next, an operation of the constant current circuit according to the second embodiment is described.

Even in a case where the N-channel transistor 201 cannot employ a transistor different in threshold from the N-channel transistor 103 and the N-channel transistor 104 due to restrictions on manufacturing process or the like, it is possible to make adjustment by the resistor 202. By adding the resistor 202, the threshold of the inverter may be adjusted to a value lower than a potential of the node A in the steady state, to thereby enable the start-up circuit section 111.

As described above, the constant current circuit according to the second embodiment employs the resistor 202 to adjust the threshold of the N-channel transistor 201 to be low, to thereby enable the start-up circuit section 111.

Third Embodiment

Figure 3:
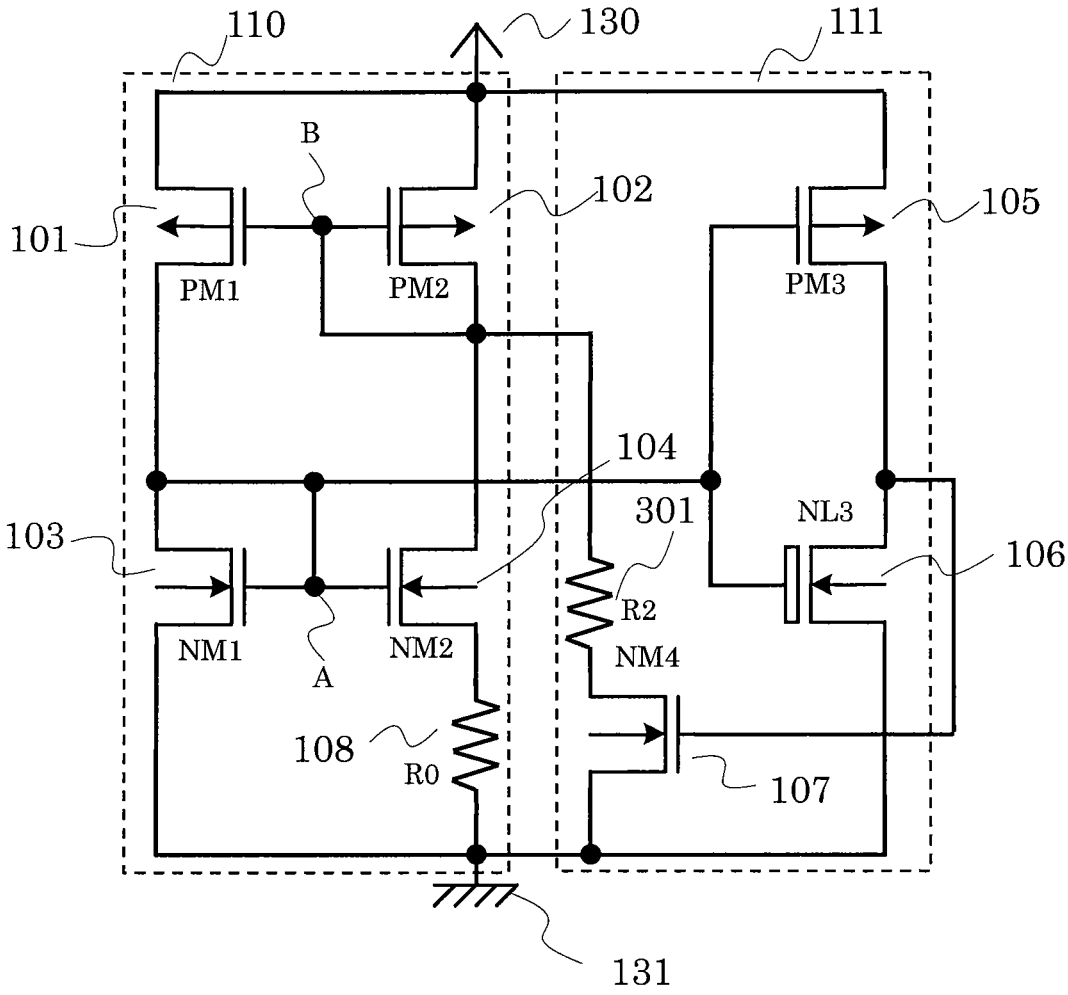
FIG. 3 is a circuit diagram of a constant current circuit according to a third embodiment of the present invention.
Figure 4:
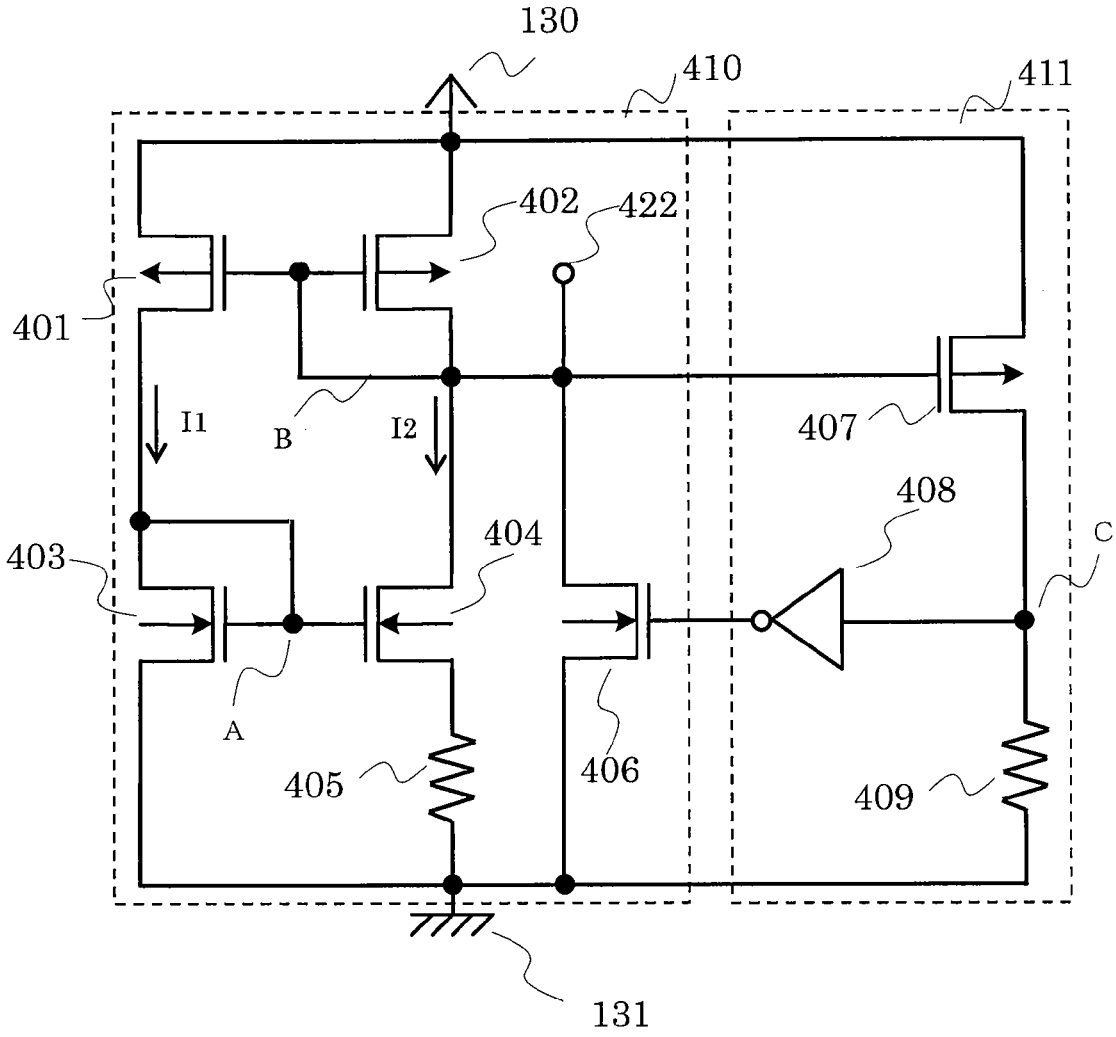
FIG. 4 PRIOR ART
FIG. 4 is a circuit diagram of a conventional constant current circuit.

FIG. 3 is a circuit diagram of a constant current circuit according to a third embodiment of the present invention.

FIG. 3 is different from FIG. 1 in that a resistor 301 is interposed between the N-channel transistor 107 and the P-channel transistor 102.

The resistor 301 has one end connected to the gate of the P-channel transistor 102 and another end connected to the drain of the N-channel transistor 107.

Next, an operation of the constant current circuit according to the third embodiment is described.

When the resistor 301 is not interposed, the excitation current by the N-channel transistor 107 is determined as {VDD−Vth(PM2)}/Ron(NM4), where VDD is the power supply voltage, Vth(PM2) is the threshold of the P-channel transistor 102, and Ron(NM4) is an ON-state resistance of the N-channel transistor 107. As apparent from the expression, as the power supply voltage becomes larger, a value of the excitation current increases, resulting in increased current consumption during start-up. As a method of limiting the excitation current, the resistor 301 is interposed to limit such start-up current. The excitation current when the resistor 301 is used is determined as {VDD−Vth(PM2)}/{Ron(NM4)+R2}, where R2 is a resistance of the resistor 301. As apparent from the expression, it is possible to limit the excitation current by increasing R2.

As described above, the constant current circuit according to the third embodiment employs the resistor 301 to limit the current during start-up to be low, to thereby enable the start-up circuit section 111.

Fourth Embodiment

Figure 5:
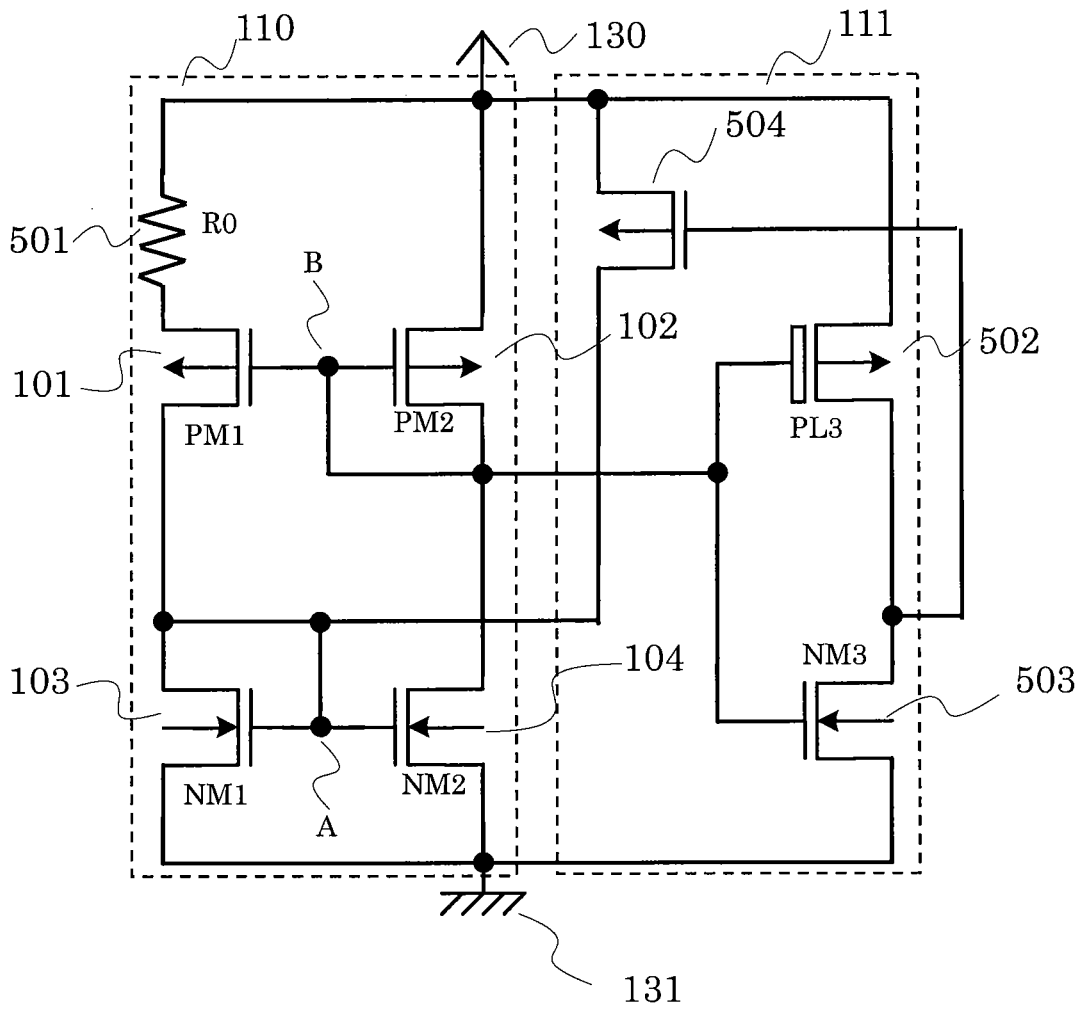
FIG. 5 is a circuit diagram of a constant current circuit according to a fourth embodiment of the present invention.

FIG. 5 is a circuit diagram of a constant current circuit according to a fourth embodiment of the present invention.

The constant current circuit of FIG. 5 is of opposite conductivity type to the constant current circuit of FIG. 1.

Next, an operation of the constant current circuit according to the fourth embodiment is described.

A P-channel transistor 502 employs a transistor lower in threshold than the P-channel transistor 101 and the P-channel transistor 102.

After power is activated, if the node B has a potential lower than the threshold of the P-channel transistor 502, the P-channel transistor 502 and an N-channel transistor 503 of the start-up circuit section 111 determine that the constant current circuit section 110 is not in a start-up state and thereby output a start-up signal to a P-channel transistor 504. Then, the P-channel transistor 504 allows an excitation current to flow into the N-channel transistor 103. The N-channel transistor 103 and the N-channel transistor 104 together form a current mirror circuit and thereby generate the excitation current to the N-channel transistor 104. The excitation current by the N-channel transistor 104 discharges a ground parasitic capacitance of the node B to turn ON the P-channel transistor 102 and the P-channel transistor 101. On this occasion, if each gate potential of the P-channel transistor 101 and the P-channel transistor 102 falls below a threshold of an inverter formed by the N-channel transistor 503 and the P-channel transistor 502, the output of the inverter is inverted from Low to High. Then, the P-channel transistor 504 is shifted to the cut-off region operation, ending the supply of the excitation current. At this time, sufficient currents flow through the P-channel transistor 101, the P-channel transistor 102, the N-channel transistor 103, and the N-channel transistor 104, and hence the constant current circuit section 110 is shifted to the steady state without fail.

Although not illustrated, the start-up circuit section 111 may employ another configuration in which the P-channel transistor 502 has the same threshold as the P-channel transistor 101 and the P-channel transistor 102, and a resistor is interposed between a drain of the P-channel transistor 502 and a drain of the N-channel transistor 503 so as to adjust the threshold of the inverter, to thereby enable the start-up circuit section.

Further, although not illustrated, the current during start-up may be limited by interposing a resistor between a drain of the P-channel transistor 504 and the gate of the N-channel transistor 103.

As described above, in the constant current circuit according to the fourth embodiment, until the node B reaches a start-up state, the excitation current is continued to be supplied to the node A, to thereby reliably start up the constant current circuit in a short period of time without repeating the start-up state and the zero steady state.

What is claimed is:

1. A constant current circuit, comprising:

a constant current circuit section comprising:

a first transistor including a source connected to a first power source;

a second transistor including a drain and a gate which are connected to a drain of the first transistor, and a source connected to a second power source;

a third transistor including a source connected to the first power source, and a drain and a gate which are connected to a gate of the first transistor; and a fourth transistor including a source connected to a first resistor, a gate connected to the gate and the drain of the second transistor, and a drain connected to the gate and the drain of the third transistor, the first resistor including one end connected to the source of the fourth transistor and another end connected to the second power source; and a start-up circuit comprising:

a fifth transistor including a source connected to the first power source, and a gate connected to the gate of the second transistor;

a sixth transistor including a source connected to the second power source, and a gate connected to the gate of the second transistor; and a seventh transistor including a gate connected to a drain of the fifth transistor and a drain of the sixth transistor, a drain connected to the gate of the third transistor, and a source connected to the second power source.

2. A constant current circuit according to claim 1, wherein the sixth transistor is lower in absolute value of a threshold than the second transistor and than the fourth transistor.

3. A constant current circuit according to claim 2, further comprising a third resistor between the drain of the seventh transistor and the gate of the third transistor.

4. A constant current circuit according to claim 1, further comprising a second resistor between the drain of the fifth transistor and the drain of the sixth transistor.

5. A constant current circuit according to claim 1, further comprising a third resistor between the drain of the seventh transistor and the gate of the third transistor.

6. A constant current circuit, comprising:

a constant current circuit section comprising:

a first resistor including one end connected to a first power source;

a first transistor including a source connected to another end of the first resistor;

a second transistor including a drain and a gate which are connected to a drain of the first transistor, and a source connected to a second power source;

a third transistor including a source connected to the second power source, and a gate connected to the gate of the second transistor; and a fourth transistor including a source connected to the first power source, and a gate and a drain which are connected to the gate of the first transistor and a drain of the third transistor; and a start-up circuit comprising:

a fifth transistor including a source connected to the second power source, and a gate connected to the gate of the fourth transistor;

a sixth transistor including a source connected to the first power source, and a gate connected to the gate of the fourth transistor; and a seventh transistor including a gate connected to a drain of the fifth transistor and a drain of the sixth transistor, a drain connected to the gate of the third transistor, and a source connected to the first power source.

7. A constant current circuit according to claim 6, wherein the sixth transistor is lower in absolute value of a threshold than the first transistor and than the fourth transistor.

8. A constant current circuit according to claim 7, further comprising a third resistor between the drain of the seventh transistor and the gate of the third transistor.

9. A constant current circuit according to claim 6, further comprising a second resistor between the drain of the fifth transistor and the drain of the sixth transistor.

10. A constant current circuit according to claim 6, further comprising a third resistor between the drain of the seventh transistor and the gate of the third transistor.

* * * * *